US007401827B1

(12) United States Patent
McGuerty

(10) Patent No.: US 7,401,827 B1
(45) Date of Patent: Jul. 22, 2008

(54) BOTTLE TOTE

(76) Inventor: Sean McGuerty, 24 Frost St., Billerica, MA (US) 01821

( * ) Notice: Subject to any disclaimer, the term of this patent is extended or adjusted under 35 U.S.C. 154(b) by 139 days.

(21) Appl. No.: 11/459,984

(22) Filed: Jul. 26, 2006

(51) Int. Cl.
*B65D 23/10* (2006.01)

(52) U.S. Cl. ..... 294/27.1; 294/92; 215/396

(58) Field of Classification Search ..... 294/27.1, 294/31.2, 15, 90–92, 164; 215/396, 399
See application file for complete search history.

(56) References Cited

U.S. PATENT DOCUMENTS

| | | | | | |
|---|---|---|---|---|---|
| 1,298,662 | A | * | 4/1919 | Chadwick | 294/2 |
| 1,412,054 | A | * | 4/1922 | Hagerman | 294/34 |
| 1,491,118 | A | * | 4/1924 | Uvary | 294/33 |
| 1,993,976 | A | * | 3/1935 | Nelson | 294/31.2 |
| 2,308,744 | A | * | 1/1943 | Buys | 294/28 |
| 4,236,743 | A | | 12/1980 | Fox | |
| 4,456,135 | A | * | 6/1984 | Beekes | 215/396 |
| 4,821,372 | A | | 4/1989 | Casiello | |
| D317,843 | S | | 7/1991 | Gagnon | |
| 5,085,477 | A | * | 2/1992 | Gagnon | 294/28 |
| D340,789 | S | * | 10/1993 | Merritt | D34/28 |
| 5,667,265 | A | | 9/1997 | Gebhard | |
| 5,752,732 | A | | 5/1998 | Beaton et al. | |
| 5,957,513 | A | | 9/1999 | Merritt | |
| 6,042,164 | A | | 3/2000 | Merritt | |
| 6,364,385 | B1 | * | 4/2002 | Steward et al. | 294/27.1 |
| 2004/0188377 | A1 | * | 9/2004 | Balade | 215/396 |

* cited by examiner

*Primary Examiner*—Dean J Kramer
(74) *Attorney, Agent, or Firm*—Advantia Law Group; Michael W. Starkweather; Jason P. Webb

(57) ABSTRACT

A novel bottle tote for manually toting bottles at least includes the following: a tote frame member; a tote ring member connected to a first end of the tote frame member; a tote handle member connected to a second end of the tote frame member; and a tote elbow member formed from a bend in the tote frame member between the tote ring member and the tote handle member; wherein the tote elbow member and a portion of the tote ring member are adapted to grip an inserted bottleneck of a bottle to be toted, and the tote handle member is adapted to receive a manual lifting force which is transmitted through the tote frame member, the tote elbow member and the tote ring member to the bottleneck of the bottle.

6 Claims, 1 Drawing Sheet

BOTTLE TOTE

BACKGROUND OF THE INVENTION

1. Field of the Invention

The present invention generally relates to methods and apparatuses for carrying or toting water large bottles.

2. Description of the Related Art

Large water bottles such as the five gallon water cooler varieties having spring or purified water are often awkward and difficult to carry by one person. The typical prior art approach usually involves the use of two hands, or for those with great strength, grasping the neck of the bottle. The latter approach is likely to leave the bottle mover with skeletal muscular problems and injuries because of great stress on the hands and arms in unnatural positions.

What is needed but not provided for by the prior art, is an apparatus for aiding the lifting and transport of individual large beverage bottles (while fill) without the associated awkwardness and injury risks.

SUMMARY OF THE INVENTION

The present invention has been developed in response to the present state of the art, and in particular, in response to the problems and needs in the art that have not yet been fully solved. Accordingly, the present invention has been developed to provide a novel bottle tote for manually toting bottles that at least includes the following: a tote frame member; a tote ring member connected to a first end of the tote frame member; a tote handle member connected to a second end of the tote frame member; and a tote elbow member formed from a bend in the tote frame member between the tote ring member and the tote handle member; wherein the tote elbow member and a portion of the tote ring member are adapted to grip an inserted bottleneck of a bottle to be toted, and the tote handle member is adapted to receive a manual lifting force which is transmitted through the tote frame member, the tote elbow member and the tote ring member to the bottleneck of the bottle.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Figure 1:
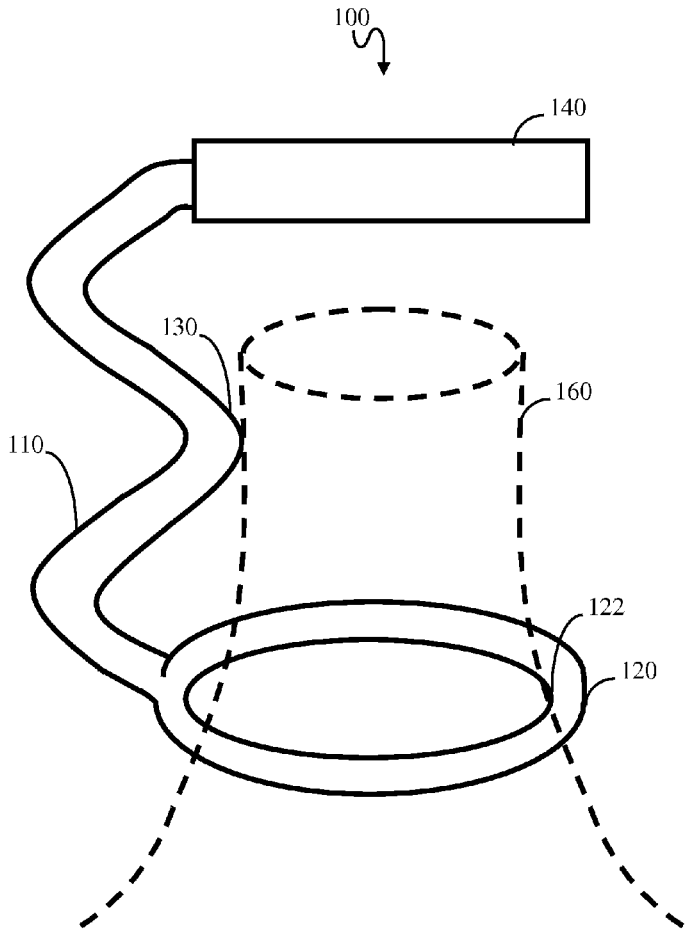
FIG. 1—the sole drawing FIGURE—is a side view of the present-inventive bottle tote.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to "one embodiment," "an embodiment," or similar language means that a particular feature, structure, or characteristic described in connection with the embodiment is included in at least one embodiment of the present invention. Thus, appearances of the phrases "one embodiment," "an embodiment," and similar language throughout this specification may, but do not necessarily, all refer to the same embodiment.

The present-inventive bottle tote 100 illustrated in FIG. 1 is specially adapted to allow a user to lift and tote large bottles such as the one numbered 160. The core of the tote 100 is a tote frame member 110 which can be constructed of suitable material including metal, sturdy plastic, Kevlar®, and others.

At one end of the tote frame member is a tote ring member 120 as shown. At another end of the tote frame member 110 is a tote handle member 140 as shown. A tote elbow member 130 is formed from a bend in the tote frame member. The bend can be molded into the original frame, or constructed later with a bending mechanism. The tote ring member is approximately three inches in diameter to accommodate a wide range of bottleneck sizes.

To tote a bottle the tote ring member 120 is placed around a bottleneck. The tote elbow member 130 and the distal region 122 of the tote ring member form an interference fit with the bottleneck. The bottle is lifted and toted via the tote handle member 140. In the preferred embodiment the handle is substantially aligned with the ring as shown, although this need not be the case. Also in the preferred embodiment, the longitudinal axis of the handle 140 is substantially parallel to the plane of the ring 120 when the tote 100 is in a non-deformed state.

It is understood that the above-described preferred embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claim rather than by the foregoing description. All changes which come within the meaning and range of equivalency of the claims are to be embraced within their scope.

It is expected that there could be numerous variations of the design of this invention.

Finally, it is envisioned that the components of the device may be constructed of a variety of materials.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A bottle tote for manually toting bottles, said bottle tote comprising:

a tote frame member;

a tote ring member connected to a first end of said tote frame member; wherein said tote ring member and said tote frame member are constructed from the same molding;

a tote handle member connected to a second end of said tote frame member; and a tote elbow member formed from a bend in said tote frame member between said tote ring member and said tote handle member; wherein the tote elbow member includes a plurality of accordion-like bends; wherein the tote ring member is connected only to the tote handle member and only through a single tote elbow member; wherein the longitudinal axis of the of the handle is substantially parallel to the plane of the ring when the tote is in a non-deformed state; and wherein said tote elbow member and a portion of said tote ring member are adapted to grip an inserted bottleneck of a bottle to be toted, and said tote handle member is adapted to receive a manual lifting force which is transmitted through said tote frame member, said tote elbow member and said tote ring member to the bottleneck of said bottle.

2. The bottle tote of claim 1, wherein said tote ring member is metallic.

3. A bottle tote for manually toting bottles, said bottle tote consisting of:

a tote frame member;

a tote ring member connected to a first end of said tote frame member; wherein said tote ring member and said tote frame member are constructed from the same molding;

a tote handle member connected to a second end of said tote frame member; and a tote elbow member formed from a bend in said tote frame member between said tote ring member and said tote handle member; wherein the tote elbow member includes a plurality of accordion-like bends; wherein the tote ring member is connected only to the tote handle member and only through a single tote elbow member; wherein the longitudinal axis of the of the handle is substantially parallel to the plane of the ring when the tote is in a non-deformed state; and wherein said tote elbow member and a portion of said tote ring member are adapted to grip an inserted bottleneck of a bottle to be toted, and said tote handle member is adapted to receive a manual lifting force which is transmitted through said tote frame member, said tote elbow member and said tote ring member to the bottleneck of said bottle.

4. The bottle tote of claim 3, wherein said tote ring member is metallic.

5. A bottle tote for manually toting bottles, said bottle tote consisting essentially of:

a tote frame member;

a tote ring member connected to a first end of said tote frame member; wherein said tote ring member and said tote frame member are constructed from the same molding;

a tote handle member connected to a second end of said tote frame member; and a tote elbow member formed from a bend in said tote frame member between said tote ring member and said tote handle member; wherein the tote elbow member includes a plurality of accordion-like bends; wherein the tote ring member is connected only to the tote handle member and only through a single tote elbow member; wherein the longitudinal axis of the of the handle is substantially parallel to the plane of the ring when the tote is in a non-deformed state; and wherein said tote elbow member and a portion of said tote ring member are adapted to grip an inserted bottleneck of a bottle to be toted, and said tote handle member is adapted to receive a manual lifting force which is transmitted through said tote frame member, said tote elbow member and said tote ring member to the bottleneck of said bottle.

6. The bottle tote of claim 5, wherein said tote ring member is metallic.

* * * * *